US005979140A

United States Patent [19]

Focke et al.

[11] Patent Number: 5,979,140

[45] Date of Patent: Nov. 9, 1999

[54] PACKAGING MACHINE FOR THE PRODUCTION OF CIGARETTE PACKETS

[75] Inventors: Heinz Focke, Verden; Hans-Jürgen Bretthauer, Bremen, both of Germany

[73] Assignee: Focke & Co. (GmbH & Co.), Verden, Germany

[21] Appl. No.: 08/992,967

[22] Filed: Dec. 18, 1997

[30] Foreign Application Priority Data

Dec. 27, 1996 [DE] Germany ..... 196 54 394

[51] Int. Cl.[6] ..... B65B 11/28; B65B 9/10

[52] U.S. Cl. ..... 53/234; 53/575; 53/579

[58] Field of Search ..... 53/234, 575, 576, 53/578, 579, 252

[56] References Cited

U.S. PATENT DOCUMENTS

| | | | |
|---|---|---|---|
| 4,495,750 | 1/1985 | Fox | 53/575 |
| 4,947,617 | 8/1990 | Focke et al. | 53/575 |
| 5,806,289 | 9/1998 | Sassi et al. | 53/575 |

FOREIGN PATENT DOCUMENTS

| | | |
|---|---|---|
| 0 034 377 | 6/1981 | European Pat. Off. . |
| 0 135 388 | 3/1985 | European Pat. Off. . |
| 2 259 014 | 8/1975 | France . |
| 2032184 | 2/1971 | Germany . |
| 3046065 | 6/1982 | Germany . |
| 3545884 | 7/1987 | Germany . |

*Primary Examiner*—John Sipos
*Assistant Examiner*—Steven Jensen
*Attorney, Agent, or Firm*—Sughrue, Mion, Zinn, Macpeak & Seas, PLLC

[57] ABSTRACT

The core of a packaging machine for cigarette packets or similar packets is a rotary folding unit (11). On the perimeter of the folding unit, there are arranged holding members for packets or packet contents, for example folding mandrels (18) on the one hand and holding pockets (21) on the other hand. For reasons to do with their construction and/or function, the latter are positioned at an axial spacing from one another. In order to transfer packets or packet parts from the folding mandrels (18) to the holding pockets (21), the latter may moved relative to one another, in such a way that, in a transfer region, the folding mandrels (18) and the associated coaxial holding pockets (21) lie directly against one another.

12 Claims, 9 Drawing Sheets

PACKAGING MACHINE FOR THE PRODUCTION OF CIGARETTE PACKETS

BACKGROUND OF THE INVENTION

The invention relates to a packaging machine, especially for the production of cigarette packets, which has a group of first receptacles—folding mandrels—moved along a continuous movement path and for receiving packet contents and/or packaging material, and a group of second receptacles—holding pockets—which may be moved in a plane offset to the first receptacles—folding mandrels—, partially completed packets being able to be transferred in an axially parallel direction from first receptacles—folding mandrels—to second receptacles—holding pockets—aligned thereto, in an axially parallel direction.

In the manufacture of packets, especially cigarette packets, by high-capacity packaging machines, folding and filling steps are carried out in the region of folding assemblies, especially rotary folding units, circulating preferably continuously. It is necessary here to lead the packaging material, the packet contents and the partially completed packets towards different groups of members which are arranged along the perimeter of the rotary folding unit. In the production of (soft) pouch-type packets, the first group of receptacles consists of folding mandrels. The packets, which are partially folded or practically completed on same, are transferred in an axially parallel direction—during the rotary movement of the rotary folding unit—to an adjacent group of members or receptacles, e.g. pockets, in the region of which the packets are completed.

SUMMARY OF THE INVENTION

The purpose underlying the invention is to improve the operating sequence on packaging machines of this kind and above all to guarantee shorter cycle times with careful guiding and holding of the packets and of the packaging material.

In fulfilment of this purpose, the packaging machine according to the invention is characterised by the following features:

a) the first receptacles—folding mandrels—and the second receptacles—holding pockets—may be moved continuously along endless movement paths, b) the first receptacles—folding mandrels—on the one hand and the second receptacles—holding pockets—on the other hand are aligned in an axial direction with one another in respect of relative position and conveying speed, at least in a partial region of the movement paths, c) the first receptacles—folding mandrels—and the second receptacles—holding pockets—may be moved in an axial direction relative to one another, at least in the region of the aligned movement paths, in such a way that, in order to transfer partially completed packets from first receptacles—folding mandrels—to second receptacles—holding pockets—, there is no distance, or only very little, between same in an axial direction.

Between the groups of receptacles, especially between the folding mandrels on the one hand and the pockets on the other hand, there is a distance in an axial direction for reasons related to construction and function. This distance has to be overcome when the packets are transferred from the one group of receptacles to the other group of receptacles. To this end, in a partial region of the perimeter of the rotary folding unit, the receptacles which are adjacent in an axial direction are moved towards one another, such that they preferably close up to one another. By preference, the folding mandrels are positioned fixed while the pockets are mounted so as to be movable in an axially parallel direction to bridge the distance.

On rotary folding units circulating continuously, the movable receptacles, especially the pockets, are attached to guides which are moved by guide members acting positively, especially by sensing rollers which run on fixed curves.

Folding and holding members, which are also circulating, are associated with the folding mandrels on the one hand and the pockets on the other hand. The members belonging to the pockets are positioned stationary on the rotary folding unit, i.e. do not follow the axial movement of the pockets.

Further details of the invention relate to the structural design of the pockets, to folding and holding members associated with the pockets and to the structural configuration of the rotary folding unit as a whole.

Details of the rotary folding unit as well as of the members associated with same are explained more fully below with the aid of an embodiment of the packaging machine, given by way of example.

DESCRIPTION OF PREFERRED EMBODIMENTS

Figure 1:
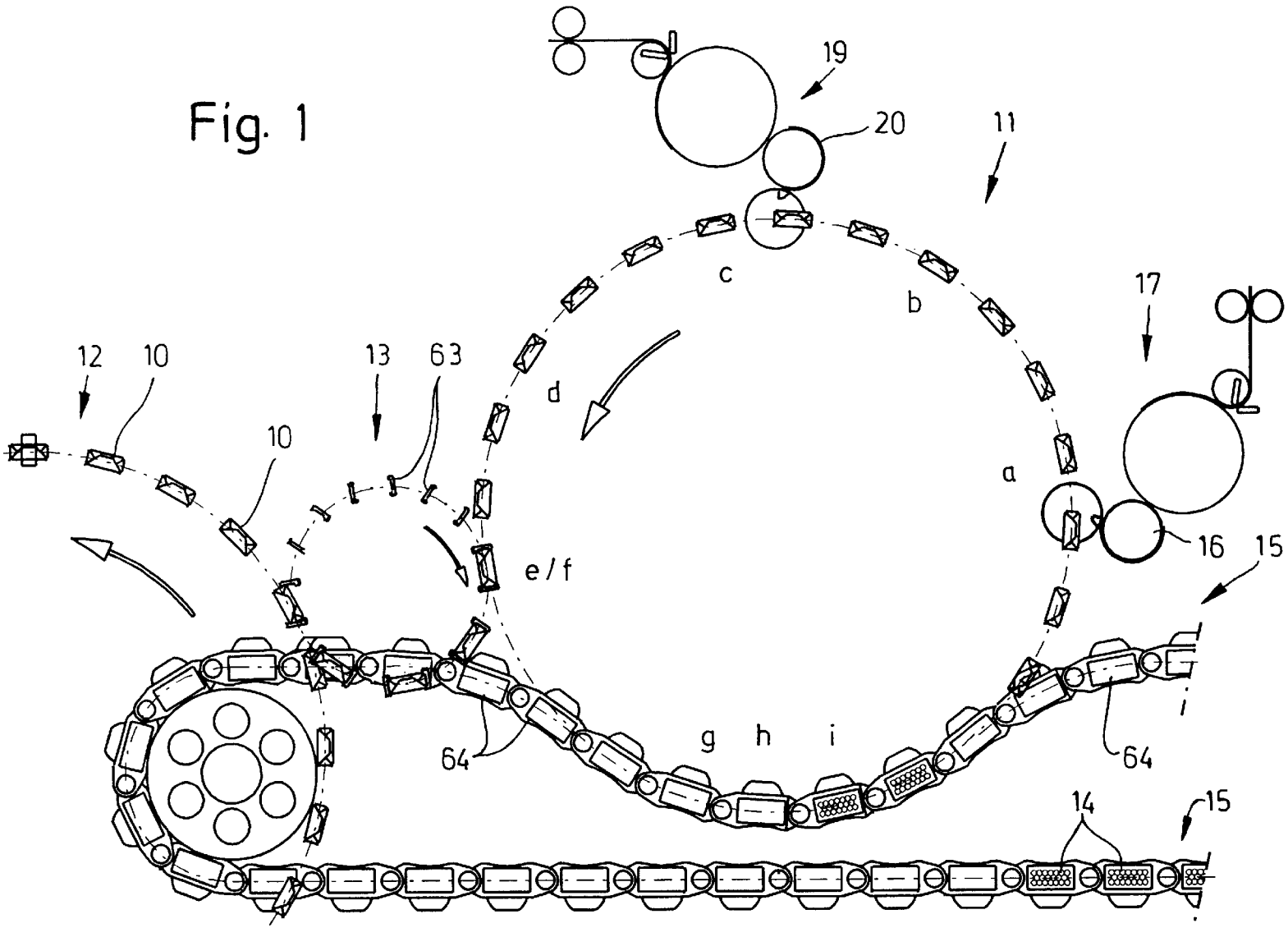
FIG. 1 shows a packaging machine or substantial assemblies of same, in diagrammatic side view.

In FIG. 1, core regions of a packaging machine for the production of cigarette packets 10 are represented diagrammatically. These are a continuously circulating rotary folding unit 11 and a rotary drying unit 12 following in the direction of movement of the packets. Between the rotary folding unit 11 and the rotary drying unit 12 there is located a rotary transfer unit 13. The packet contents, namely groups of cigarettes 14, are led to the rotary folding unit 11 by a pocket chain 15. The pockets 64 of the latter take groups of cigarettes 14 from a cigarette magazine (not shown).

The assemblies described above can be configured in known fashion. The pocket chain 15 is shown and described in an advantageous embodiment in EP 226 872. Details of the rotary folding unit 11 arise from EP 226 872. The rotary transfer unit 13 is described as an embodiment, given by way of example, in EP 605 838, as is the rotary drying unit 12.

The present embodiment of a packaging machine, given by way of example, relates to the production of cigarette packets 10 of the soft-pouch type. The groups of cigarettes 14, are in this embodiment, pushed on the perimeter of the rotary folding unit 11 in an axially parallel direction out of the pockets 64 of the pocket chain 15 into receptacles which are distributed along the perimeter of the rotary folding unit 11. During the continuous rotation of the rotary folding unit 11, the groups of cigarettes 14 are first wrapped in an inner blank 16 which consists, for example, of tinfoil or paper. The inner blank 16 is led in the region of a tinfoil assembly 17 to the rotary folding unit 11 or the group of cigarettes 14. An advantageous embodiment, given by way of example, of a tinfoil assembly 17 of this kind is the subject-matter of DE 196 44 079.3. In concrete terms, in the present embodiment, given by way of example, the inner blank is wrapped around a receptacle which is configured as a hollow folding mandrel 18.

The folding mandrels 18 provided with the inner blank 16 are conveyed from the rotary folding unit 11 into the region of a paper unit 19. This is configured in the same manner as the tinfoil assembly 17. Here an outer blank 20, made of paper for example, is held ready and folded around the inner blank 16—on the folding mandrel 18—, forming a pouch-shaped outer wrapping for the cigarette packet 10.

During the continued rotation of the rotary folding unit 11, in the lower region of same, the groups of cigarettes 14 are pushed out of pockets 64 of the pocket chain 15 and into the folding mandrels 18 or into the pre-folded blanks of the cigarette packet 10. During this process, the practically finished cigarette packets 10 together with their contents are taken by receptacles on the rotary folding unit 11 which are arranged off-set from the folding mandrels 18 in an axial direction. These are holding pockets 21. During renewed rotation of the rotary folding unit 11, the cigarette packets 10 are completed and transferred to the rotary transfer unit 13. The latter transports the cigarette packets 10 to the rotary drying unit 12.

Figure 2:
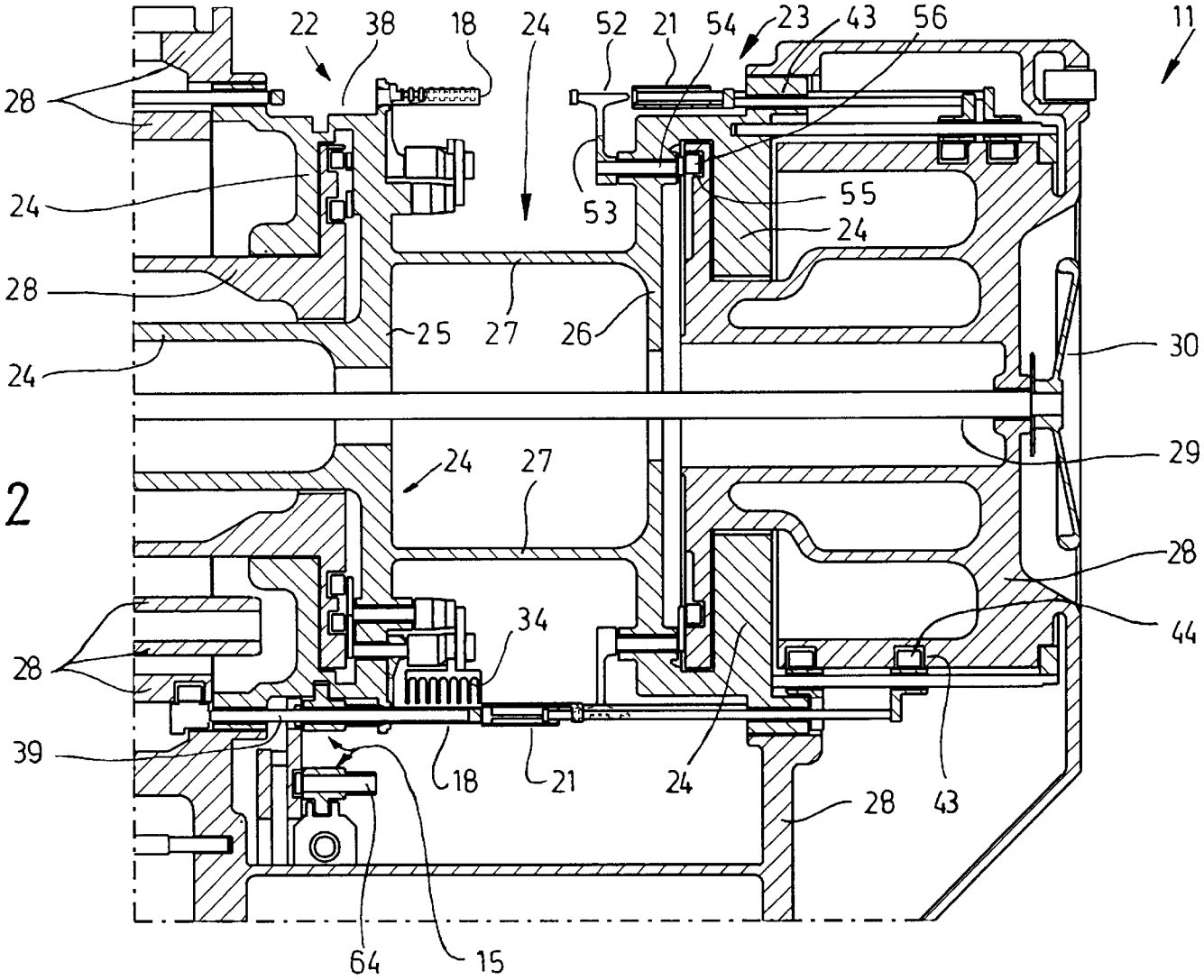
FIG. 2 shows a rotary folding unit as a detail of the packaging machine, in an axial longitudinal section.

The rotary folding unit 11 forms a special characteristic in respect of its structure and function. The (two) groups of receptacles, namely the folding mandrels 18 on the one hand and the holding pockets 21 on the other hand, are arranged along the perimeter of the common rotary folding unit 11 respectively at identical peripheral spacings from one another. The row of folding mandrels 18 on the one hand and the row of holding pockets 21 on the other hand are at a clear spacing from one another in an axial direction, this spacing being determined by its function. According to FIG. 2, the rotary folding unit 11 is configured in such a way that two partial rotary units 22 and 23 are produced. Movable portions of the two partial rotary units 22 and 23 form a (one-piece) unit, namely a rotating body 24 with radially aligned supporting walls 25, 26 and a transverse wall 27 joining these walls to one another. The folding mandrels 18 on the one hand and the holding pockets on the other hand are arranged or mounted on the radially outer limits of the supporting walls 25, 26.

The rotating body 24 is mounted on or in a fixed carrying body 28, which for its part is connected below with the machine frame (not shown). In the longitudinal center of the rotary folding unit 11 there is located a shaft 29 with a handwheel 30 for moving the rotary folding unit or the rotating body 24 manually.

The folding mandrels 18 are thin-walled, long, hollow bodies with the inner dimensions of the cigarette packets 10. The folding mandrels 18, which are open at both ends, are attached to the rotating body 24 so as to protrude or project at one side, i.e. fixed, on the supporting wall 25.

In a first production step, the inner blank 16 is laid around the folding mandrels 18 in the region of the tinfoil assembly 17. The folding mandrels 18, which are moved past the tinfoil assembly 17 by the rotation of the rotary folding unit 11, respectively take one ready inner blank 16 with them. This blank is laid on to a side wall 31 of the folding mandrel 18, lying at the front in the direction of rotation of the rotary folding unit 11, making a U-shaped fold. In the region of this side wall 31, the inner blank 16 is fixed by a pressure member, namely by a pressure roller 32 consisting of individual rollers. With each folding mandrel 18 there is associated a pressure roller 32 of this type which circulates with the rotary folding unit 11 and is pressed out of a position at a greater distance from the folding mandrel 18, once an inner blank 16 has been led to the folding mandrel 18 or to the inner blank 16 which has been received.

On the side of the folding mandrel 18 lying radially on the inside, namely on a (large-surface) inner wall 33, pressure is applied to the inner blank by a folding device 34, which is likewise associated with the or each folding mandrel 18. The folding device 34, which is angular in cross-section, presses the corresponding portion of the inner blank 16 also on to a side wall 35, at the back in the direction of conveying, of the folding mandrel 18. The folding device 34 may be actuated by a parallelogram rod assembly 67 to carry out the folding movement. This rod assembly, or its guide rods, may be moved by sensing rollers 68, 69 which enter grooves 70, 71 of the fixed portion of the rotary folding unit 11 during the rotation of same.

Figure 4:
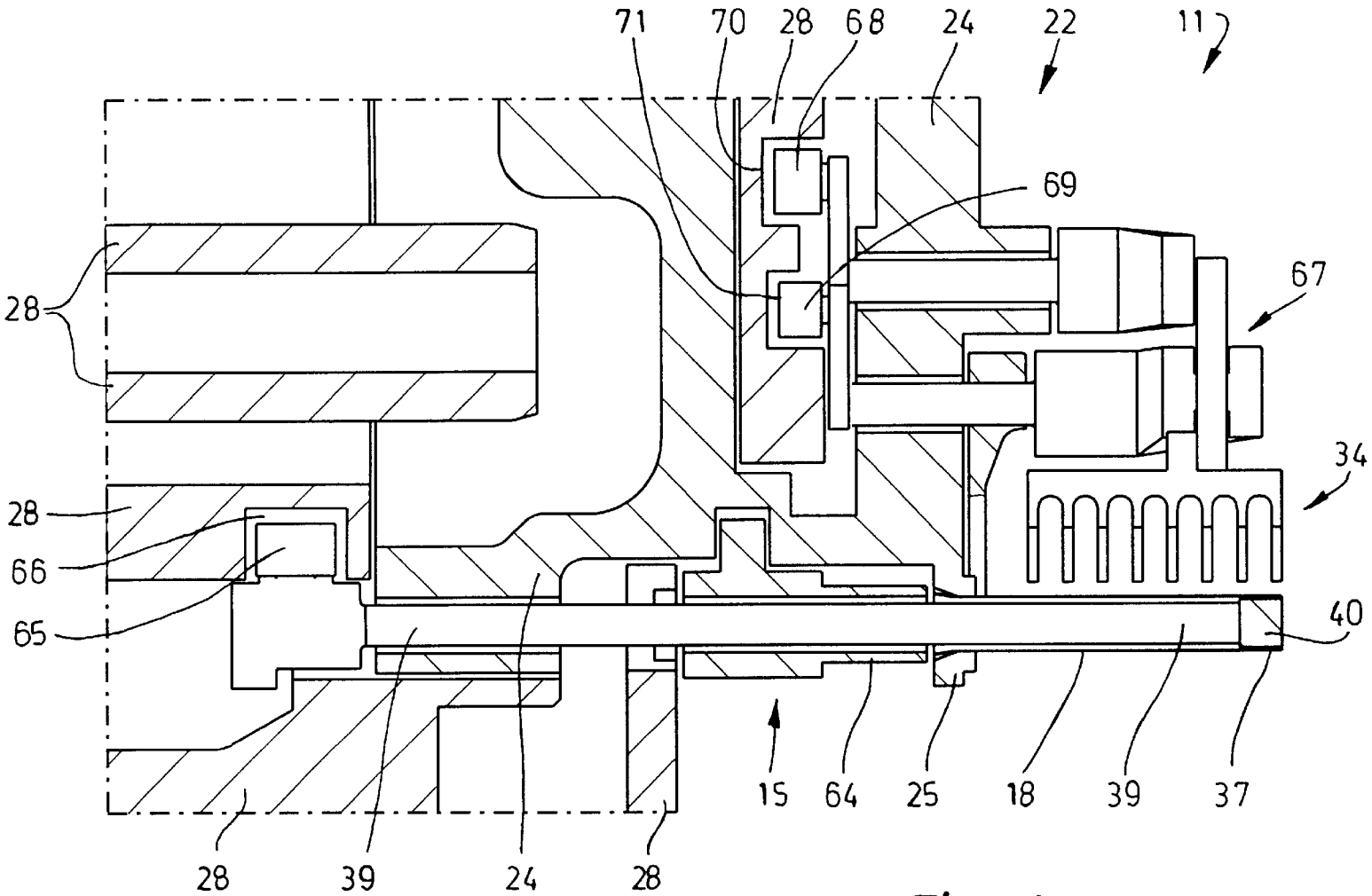
FIG. 4 shows a detail of the rotary folding unit, namely a detail of the view according to FIG. 2, on an enlarged scale.
Figure 5:
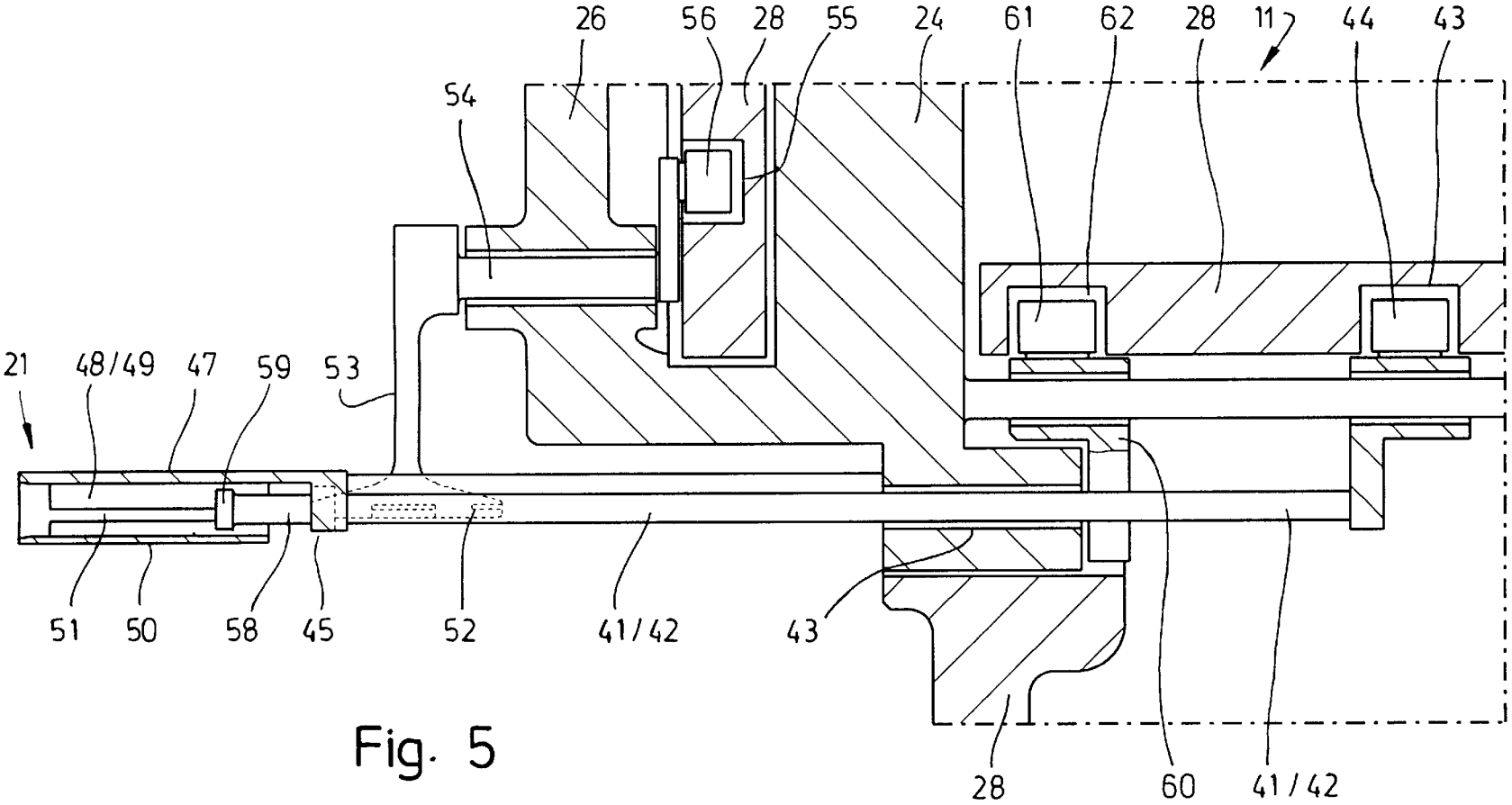
FIG. 5 shows a view corresponding to FIG. 4 for a different detail from FIG. 2.

Regions of the inner blank 16, which lie radially on the outside, are laid on to an outer wall 36 of the folding mandrel 18 by folding members not shown here. Because of the dimensions and the relative position of the inner blank 16, base folding flaps 37 protrude at the free end beyond the folding mandrel 18 (FIG. 4). The base folding flaps 37 are folded, before the outer blank 20 is applied, to form a base of the inner blank 16.

After the inner blank 16 has been folded on the folding mandrel 18, the outer blank 20 is led to the mandrel, analogously to the inner blank 16. The outer blank usually has a different relative position on the folding mandrel 18, such that overlapping folding flaps of the outer blank 20 extend in the region of the rear side wall 35 of the folding mandrel.

Once the inner blank 16 and outer blank 20 have been completed, namely folded, in the lower region of the rotary folding unit 11 the group of cigarettes 14 is inserted into the folding mandrel 18. To this end, the pockets 64 of the pocket chain 15 run coaxially with the folding mandrels 18, directly beside the latter in the region of a depression 38 in the rotating body 24. The group of cigarettes 14 is pushed, during this movement phase of the rotary folding unit 11, by a slide 39 with a slide head 40 first of all out of the pocket 64 of the pocket chain 15 and into the folding mandrel 18 via the open side. The pushing movement is continued in such a way that the group of cigarettes 14 is moved through the folding mandrel 18, taking with it the inner blank 16 and the outer blank 20, namely by drawing same away from the folding mandrel 18. Thus the group of cigarettes 14 reaches the packet which is completed to this extent. The packaging unit formed is transferred by the slide 39 to a holding pocket 21 running coaxially.

The slide 39 may be actuated by a transverse sensing roller 65 which is arranged at the end of the slide 39 and enters a circulating control groove 66 of the fixed carrying body 29. Thus the slide is actuated automatically according to the rotation of the rotary folding unit 11.

In the region of the holding pockets 21, folding of the cigarette packet 10 is completed. In particular, regions of the inner blank 16 which project beyond the group of cigarettes 14 are folded, forming an end wall of the cigarette packet 10. Then the cigarette packet 10 is led to the rotary transfer unit 13.

A special characteristic consists in the fact that the distance for transferring the packet unit from the folding mandrel 18 to a neighboring holding pocket 21, which exists between the folding mandrels 18 on the one hand and the holding pockets 21 on the other hand in the normal position, is done away with. As is clear, for example from FIG. 2, below, during this phase the folding mandrel 18 and holding pocket 21 immediately follow one another in an axial direction.

In the present embodiment, given by way of example, the holding pockets 21 may, to this end, be moved in an axially parallel direction during the rotary movement.

The holding pockets 21 are attached in an axially parallel direction to a carrier, in the present case to two carrying rods 41, 42 arranged at a spacing from one another. These rods are mounted movable in an axially parallel guide 43 on the outer perimeter of the rotating body 24. The axially parallel forward and backward movements of the carrying rods 41, 42 are effected by a circulating control groove 43, formed in the carrying body 28 and into which a sensing roller 44 connected with the carrying rods 41, 42 enters.

Figure 6:
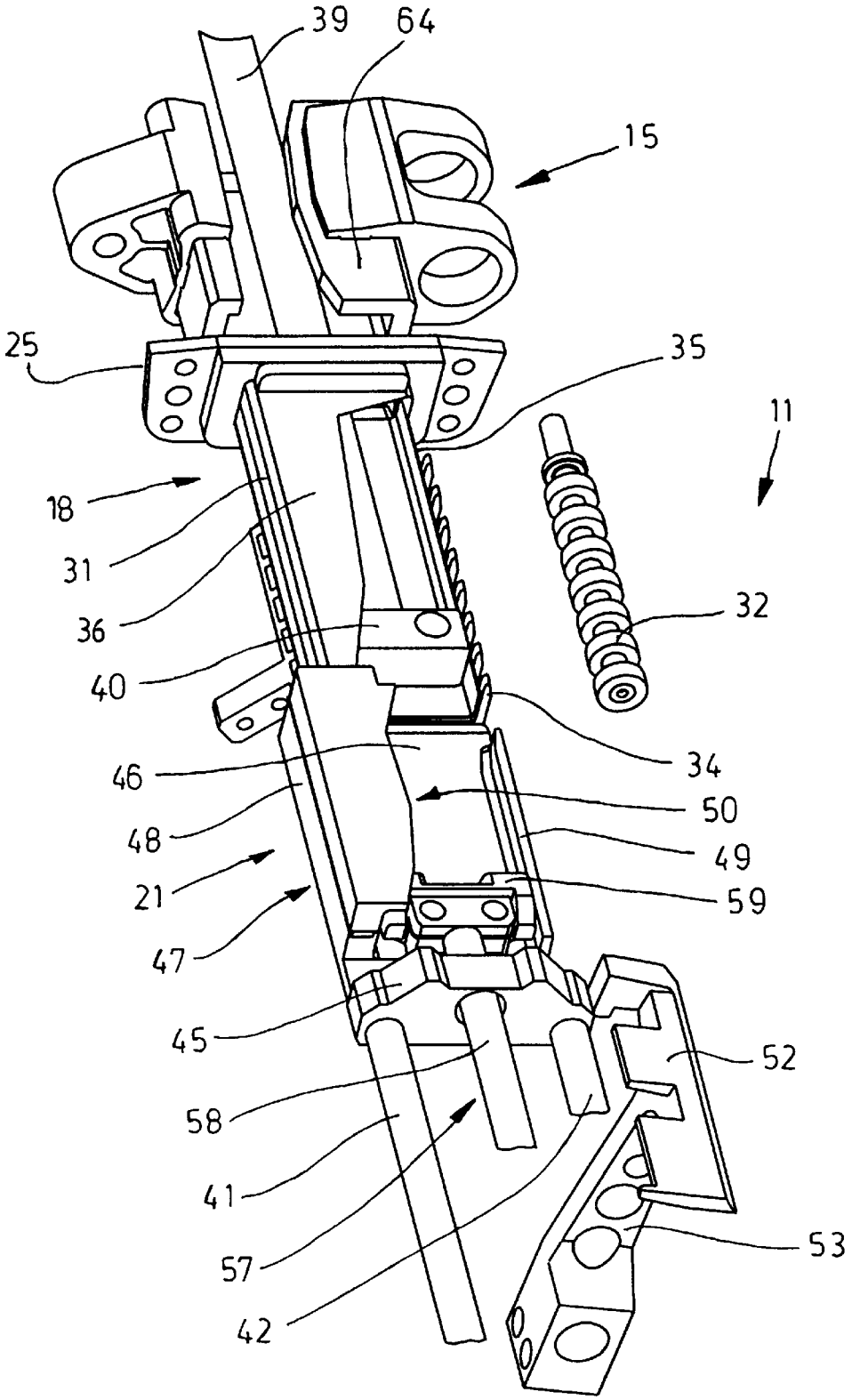
FIG. 6 shows a folding mandrel on the one hand and a pocket on the other hand in transfer position, in perspective view.

The ends, facing the holding pocket 21, of the carrying rods 41, 42 are connected to one another by a transverse crossrail 45. To this is attached the holding pocket 21. Crossrail 45 and holding pocket 21 are rigidly connected to one another, with the result that the holding pocket 21 is attached to the free ends of the carrying rods 41, 42 or to the crossrail 45, floating freely. Through the carrying rods 41, 42 being driven outwards as a result of a rotation of the rotary folding unit 11, the holding pockets 21 are moved the one after the other towards the associated folding mandrel 18 lying opposite it, until the holding pocket 21 is respectively positioned with one open side, namely an insert aperture 46, immediately adjacent to and aligned with the folding mandrel 18. The slide 39 or its head 40 can now push the cigarette packet 10 together with its contents into the holding pocket 21 (FIG. 6).

For constructional reasons, the holding pockets 21 are subdivided, consist namely of a lower pocket 47 which is U-shaped in cross-section and an upper pocket 50 which is attached to side walls 48, 49 of same. This upper pocket is connected by screwing to the lower pocket 47, namely the side walls 48, 49.

In the region of a side wall 49, the holding pocket 21 forms a longitudinal slot 51. A pressure member, namely a pressing strip 52, can pass through this slot. This strip serves temporarily to fix folding flaps of the outer wrapping or of the outer blank 20, which flaps lie the one above the other and are connected to one another by gluing. The pressing strip 52 associated with each holding pocket 21 is attached to a swivelling lever 53. The latter may be pivoted via a shaft journal 54 which, for its part, may be actuated by a sensing roller 56 running in a control groove 55. When the holding pocket 21 is displaced in an axially parallel direction, the pressing strip 52 is drawn back (position according to FIG. 6).

Figure 7:
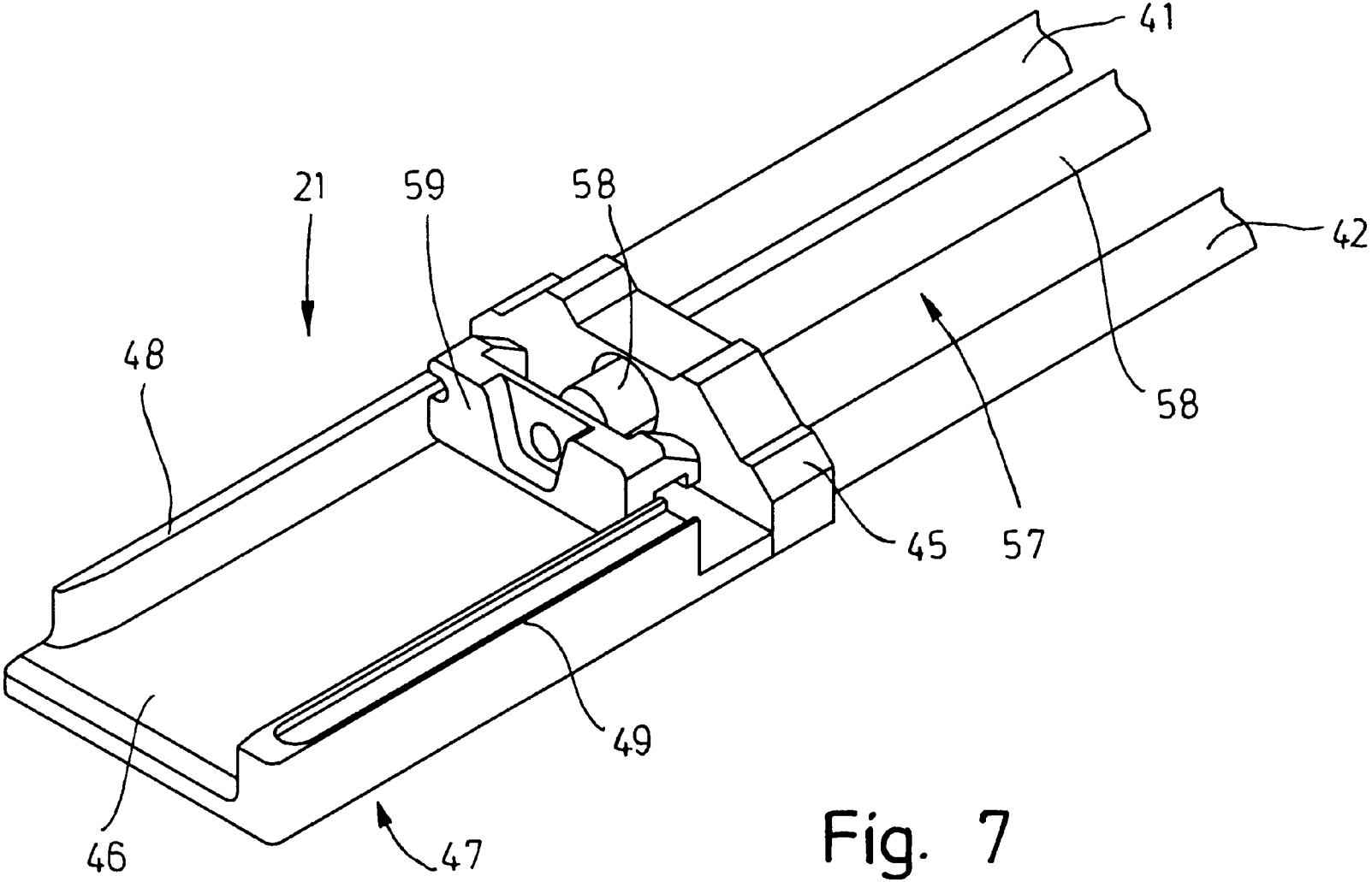
FIG. 7 shows a detail of a pocket in perspective view.
Figure 8:
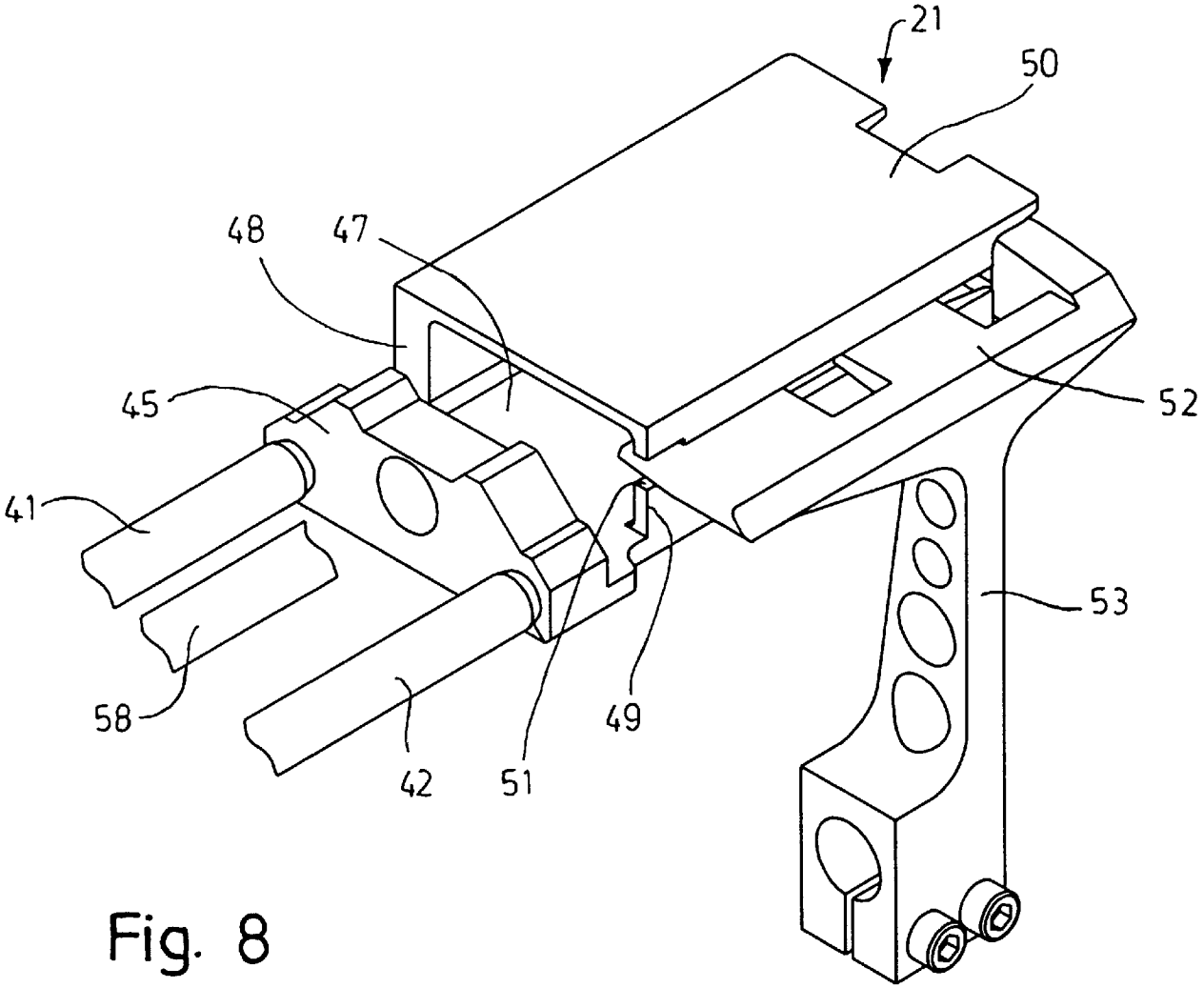
FIG. 8 shows the complete pocket with a holding member, likewise in perspective view.

With the holding pocket 21 there is likewise associated a pushing member, namely a ram 57. Its ram rod 58 is arranged between the carrying rods 41, 42. The ram rod 58 passes through the center of the crossrail 45. A ram head 59 may be moved inside the holding pocket 21 in the longitudinal direction of said pocket. The ram head 59 helps to push a cigarette packet 10 into the holding pocket 21. The ram head 59 lies first of all directly in the region of the insert aperture 46 and then creeps with the inserted cigarette packet 10 into the opposite end position, forming a base of the holding pocket 21 (position according to FIG. 7).

The movements of the ram 57 may also be controlled according to the rotary movement of the rotary folding unit 11. A sensing roller 61 is arranged on a shoulder 60 connected with the ram rod 58 and this shoulder enters a control groove 62 of the fixed carrying body 28.

The ram 57 has above all the task of pushing the completed cigarette packet 10 out of the holding pocket 21 and transferring it to the rotary transfer unit 13 in this process. During this phase, the holding pocket 21 is moved into a drawn-back position, i.e. into a position at a greater distance from the folding mandrels 18, in such a way that the relevant holding pocket 21 is moved completely out of the movement path of the other holding pockets 21 in the normal position of same (FIG. 3). in this position, the cigarette packet 10 is taken by a holding device of the rotary transfer unit 13. The latter is so positioned that its pockets circulate in the plane in which the holding pockets 21 are placed in their normal position (e.g. FIG. 2, at the top).

Figure 3:
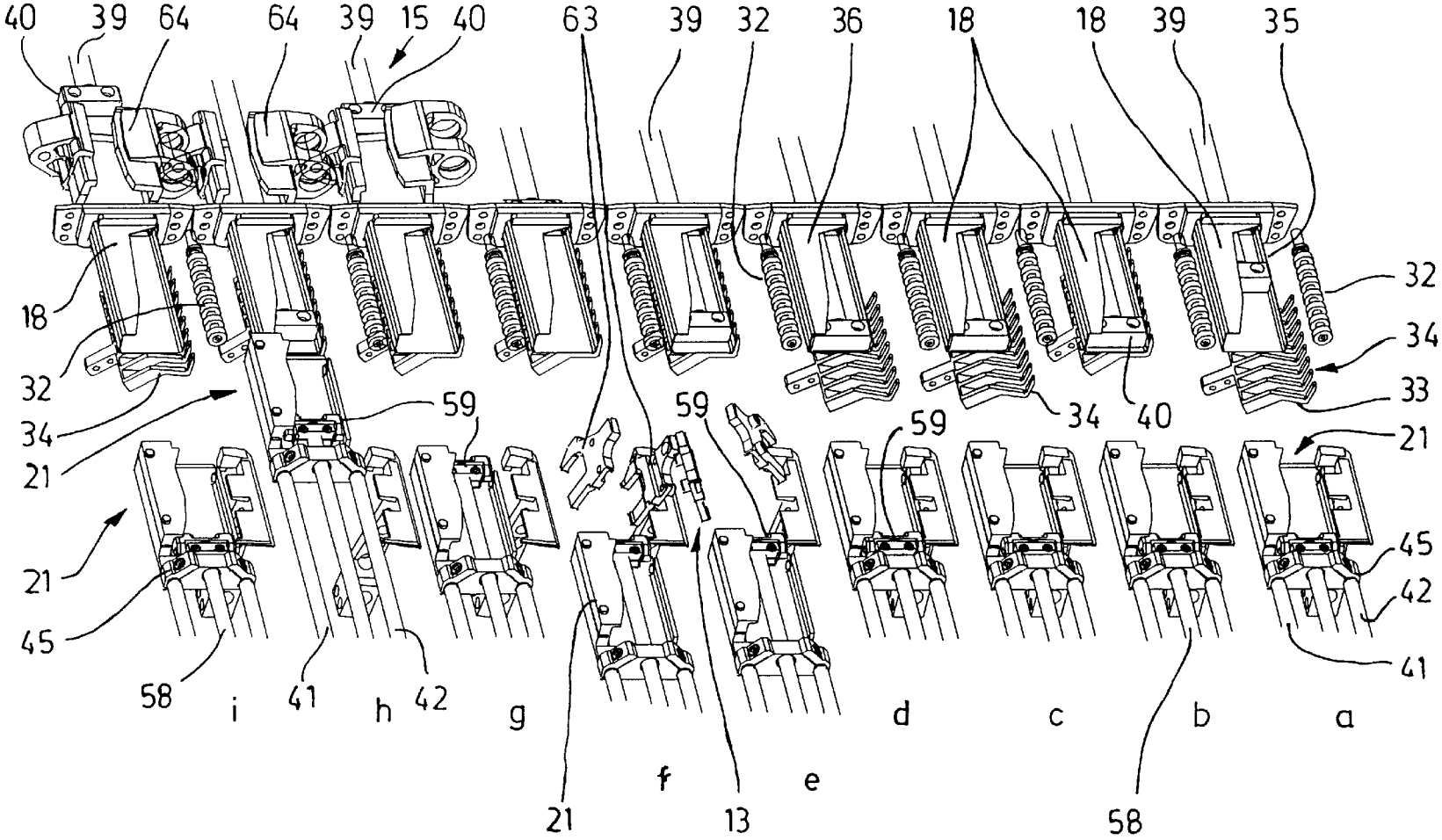
FIG. 3 shows two groups of receptacles of the rotary folding unit in a developed view, shown diagrammatically.

The sequence of the individual movements in the region of the rotary folding unit 11, in respect of the folding mandrels 18 on the one hand and the holding pockets 21 on the other hand, is shown in FIG. 3 as a developed view and in abbreviated form. The individual positions selected are identified consecutively by the letters a to i. The corresponding positions on the rotary folding unit 11 arise from FIG. 1, but it should be noted that the cigarette packets 10, or the blanks for same, are conveyed from the rotary folding unit 11 during a phase of more than one rotation of said unit.

In position a, the inner blank 16 is located on the folding mandrel 18. The folding of the base folding flaps 37 begins. The folding of the top is completed in position b. In station c, folding of base flaps of the outer blank 20 begins. This folding process is completed in station d. During the folding in the region of the base, i.e. in stations b, c, d, the slide head 40 of the slide 39 is located inside the folding mandrel 18 adjacent to the base folds, with the result that the latter are carried out against a fixed surface.

After station d, the slide head 40 is drawn back, into an end position outside the movement region of the pocket chain 15. The latter can therefore be moved past in this position g between slide head 40 and folding mandrel 18. In position g, the slide 39 is already effective in the opposite direction. The group of cigarettes 14 in the relevant pocket 64 of the pocket chain 15 is pushed by the slide head 40 out of the folding mandrel 18, taking with it the blanks on the outer side of the folding mandrel 18. The packaging unit formed in this way is led by the slide 39 into an adjacent holding pocket 21. The transfer process is carried out in position h. In this position, the holding pocket 21 is moved by a corresponding movement of the ram 57 into a position directly adjacent to the folding mandrel 18, such that the packaging unit can reach the holding pocket 21 via the open insert opening 46.

The holding pocket 21 is then driven back with the packaging unit into the normal position (position i). In this position, the pressing strip 52 becomes effective, passes through the longitudinal slot 51 of the holding pocket 21 and presses together folding flaps of the outer blank 20 which lie on this side, overlapping one another and glued to one another.

During the further movement of the rotary folding unit 11, the inner blank 16 is folded in the region of an end wall, such that the inner blank 16 completely surrounds the group of cigarettes 14. The holding pockets 21 remain in the normal position during this process, until position e/f is reached, adjacent to the rotary transfer unit 13 which is positioned in the region of the normal position of the holding pockets 21.

Figure 9:
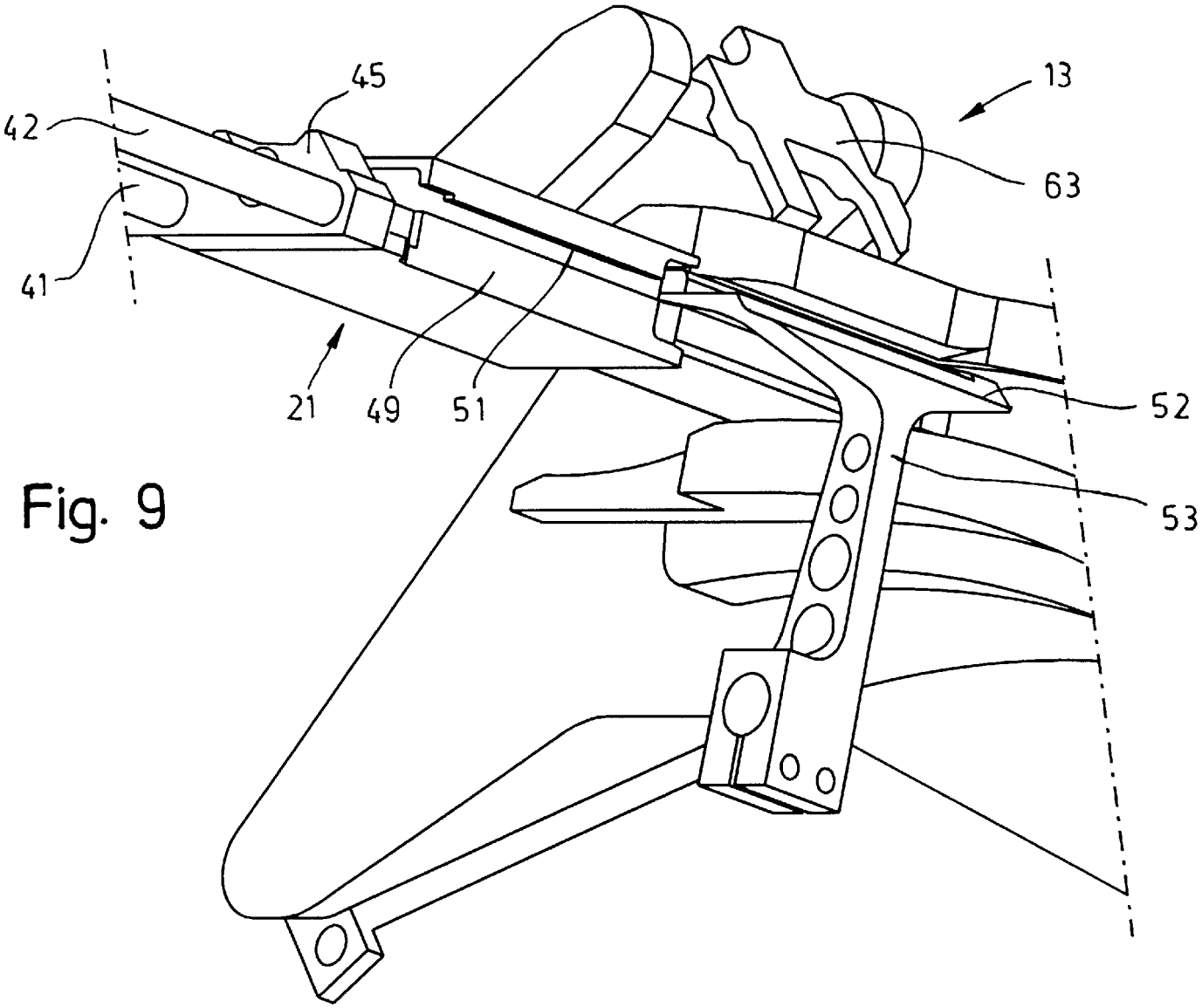
FIG. 9 shows a pocket in the region in which a packet is transferred to an onward-conveying member, in perspective view.

In order to transfer the cigarette packets 10 to the rotary transfer unit 13, the holding pockets 21 are drawn further back, i.e. enlarging the distance from the folding mandrels 18 (position according to FIG. 9). The ram 57 or its head 59 here remains in the position it has previously reached, i.e. in contact with the cigarette packet 10 in the holding pocket 21. The latter is therefore moved back relative to the cigarette packet 10 and to the ram head 59 into the position according to e and f (FIG. 3). At the same time, the exposed cigarette packet 10 is grasped by catching members or pocket walls 63 of the rotary transfer unit 13. The pressing strip 52 is drawn back from the holding pocket 21 during this phase, namely in positions e and f.

The device described can, if individual members are adapted, be used for the manufacture and filling of other types of packets, in particular also for the production of hinge-lid packets for cigarettes.

What is claimed is:

1. A packaging machine for the production of cigarette packets (10) comprising:

a group of folding mandrels (18) which are movable along a continuous movement path and which are adapted to receive packet contents, and a group of holding pockets (21) which are movable in a plane offset from the folding mandrels (18), wherein:

partially completed packets (10) are transferrable in an axially parallel direction from the folding mandrels (18) to holding pockets (21) aligned therewith:

the folding mandrels (18) and the holding pockets (21) are continuously movable along endless movement paths:

the folding mandrels (18) and the holding pockets (21) are aligned in an axial direction with one another in respect of relative position and conveying speed, at least in a partial region of the movement paths;

the folding mandrels (18) and the holding pockets (21) are movable in an axial direction relative to one another in a region of the aligned movement paths such that, in order to transfer partially completed packets (10) from the folding mandrels (18) to the holding pockets (21), there is no, or only very little, distance between the folding mandrels and holding packets in an axial direction; and the holding pockets (21) project on one side of a carrier which is movable in the axially parallel direction.

2. The packaging machine according to claim 1, wherein said carrier comprises carrying rods (41, 42) which are moved by sensing rollers (44) in control grooves (43).

3. The packaging machine according to claim 2, wherein the carrying rods (41, 42) have ends which face a holding pocket (21), and which are connected to one another by a crossrail (45), and wherein the holding pocket (21) is disposed on the crossrail (45).

4. A packaging machine for the production of cigarette packs (10) of the hinge-lid type, comprising:

a rotary folding unit (11), rotatable about an axis, having folding mandrels for the packs' contents, and packaging material arranged along a perimeter of the rotary folding unit; and holding pockets (21) which are assigned to respective ones of the folding mandrels (18), and which are arranged in a plane offset in the axial direction, partially completed packs (10) being transferrable in an axis-parallel direction from each of the folding mandrels (18) to an adjacent one of the holding pockets (21), wherein:

a) the holding pockets (21) are normally positioned at an axial distance from the folding mandrels (18), said distance corresponding approximately to the size of one pack (10);

b) for receiving a partially completed pack (10) from an assigned folding mandrel (18) during continued non-intermittent rotational movement of the rotary folding unit (11), the holding pockets (21) are displaceable in a direction parallel to the axis of the respective folding mandrel (18);

c) in an end position of each holding pocket (21) directly adjacent to its respective folding mandrel (18), one of the packs (10) is introducible into the holding pocket (21) by being pushed out from the folding mandrel; and d) after the pack (10) has been introduced into the holding pocket (21), means are provided for moving the holding pocket pack to said normal position at a distance from the folding mandrel (18).

5. The packaging machine according to claim 4, wherein the rotary folding unit (11) comprises first and second partial rotary units (22, 23) which are arranged beside one another and are interconnected, the folding mandrels (18) being arranged on the first partial rotary unit (22) and the holding pockets (21) being arranged on the second partial rotary unit (23).

6. The packaging machine according to claim 4, wherein the holding pockets (21) are movable by mechanical control members, during the rotary movement of the rotary folding unit (11), in an axis-parallel direction into a position directly adjacent to their respective folding mandrels (18) and then back into their normal positions.

7. The packaging machine according to claim 4, wherein the holding pockets (21) are movable into an additional position at a distance from the normal position, in such a way that, when the holding pockets (21) are moved to the additional position, the pocket contents are pushed out and transferred to an onward conveyor (13).

8. The packaging machine according to claim 4, wherein the contents of the folding mandrels (18), namely a cigarette group (14), are fed to the folding mandrels (18) by a pocket chain (15) with pockets (64) for accommodating one cigarette group (14) each, there being provided a slide (39) having a slide head (40) to push the cigarette group out of a pocket (64) and into the respective adjacent folding mandrel (18), and to push the cigarette group (14) with the partially completed pack out of the folding mandrel (18) and into the adjacent holding pocket (21).

9. The packaging machine according to claim 4, wherein the holding pockets (21) have, on a side facing the folding mandrel (18), an insert aperture (46) for the cigarette packs (10) and, on an opposite side, a base (59) which is movable inside the holding pocket (21).

10. The packaging machine according to claim 4, wherein the holding pockets (21) are arranged on and project from one side of a carrier which is movable in the axis-parallel direction, said carrier comprising carrying rods (41, 42) which are movable by sensing rollers (44) in control grooves (43).

11. The packaging machine according to claim 10, wherein: the carrying rods (41, 42) have ends which face a holding pocket (21) and which are connected to one another by a crossrail (45); and the holding pocket (21) is disposed on this crossrail (45).

12. The packaging machine according to claim 4, wherein the holding pocket (21) has a closed cross-section, and has at least on one side (49) a longitudinal slot (51) through which a movable pressure organ (52) can pass to press together folding flaps of the cigarette pack (10).

* * * * *